US005980393A

United States Patent [19]

Molinaroli et al.

[11] Patent Number: 5,980,393

[45] Date of Patent: Nov. 9, 1999

[54] GOLF CLUB WITH LASER SYSTEM

[75] Inventors: Carl Joseph Molinaroli, Mt. Pleasant, S.C.; James Millard Penson, Surgoinsville, Tenn.; Finbar Anthony O'Reilly, Charleston, S.C.

[73] Assignee: Laser Precision Products LLC, Greenville, S.C.

[21] Appl. No.: 09/015,999

[22] Filed: Jan. 30, 1998

[51] Int. Cl.[6] ..... A63B 69/36

[52] U.S. Cl. ..... 473/220; 362/259

[58] Field of Search ..... 473/220; 362/259

[56] References Cited

U.S. PATENT DOCUMENTS

| | | | |
|---|---|---|---|
| 4,306,723 | 12/1981 | Rusnak | 273/186 |
| 4,971,327 | 11/1990 | Rabold | 273/186 |
| 5,029,868 | 7/1991 | Cloud | 273/186 |
| 5,165,691 | 11/1992 | Cook | 273/186.3 |
| 5,169,150 | 12/1992 | Tindale | 273/187.4 |
| 5,193,812 | 3/1993 | Hendricksen | 273/186.3 |
| 5,388,832 | 2/1995 | Hsu | 273/186.3 |
| 5,435,562 | 7/1995 | Stock et al. | 273/186.3 |
| 5,464,221 | 11/1995 | Carney | 273/186.3 |
| 5,464,222 | 11/1995 | Carney | 273/186.3 |
| 5,465,972 | 11/1995 | Cornett | 273/186.3 |
| 5,482,283 | 1/1996 | Wall | 273/186.3 |
| 5,593,354 | 1/1997 | Falossi et al. | 473/220 |
| 5,611,739 | 3/1997 | Carney | 473/220 |
| 5,707,296 | 1/1998 | Hodgson et al. | 473/220 |
| 5,792,001 | 8/1998 | Henwood | 473/220 X |

*Primary Examiner*—George J. Marlo

[57] ABSTRACT

A golf club putter with a laser system for practising putting, comprising:

(a) a putter assembly which comprises a putter head member comprising two laser ports on an anterior putting face of the putter head member; and (b) a compact laser system comprising two or more laser units, laser holders, a laser module, an on-off program switch, and a power source;

wherein each laser unit is contained within a laser holder, and the laser holders are affixed to the laser module; the laser system is operable to produce parallel laser beams projected from the anterior putting face; the on-off program switch is connected to the power source; and the laser system is housed entirely in the putter head member; and whereby the laser beams are visible to assist a golfer during putting practice is provided. A space-saving circuit for the putter is also provided.

7 Claims, 10 Drawing Sheets

GOLF CLUB WITH LASER SYSTEM

BACKGROUND OF THE INVENTION

1. Technical Field

The present invention relates to a golf club containing a laser system, and more particularly to a practice putter with a compact laser system, including a power source, wholly contained in the putter head.

2. Background Information

Avid golfers have employed various devices over the years for improving their golf swing. One such device is a golf club putter with a laser aiming system. Briefly, by observing the laser beam projected from the putter during the swing, the golfer can adjust and, with practice, improve his or her putting stroke.

Here, a compact, self-contained, removable laser system has been developed which will fit entirely in the head of a standard-sized putter or other golf club. Because the laser system, including the power source, is wholly contained in the putter head, the hosel, shaft and grip are not oddly shaped and the putter has a normal appearance, and a good feel and weight distribution. The present device can be used to diagnose errors in a golfer's address and putting stroke.

The putter with laser system of the present invention comprises a grip, shaft, hosel and putter head member, and a laser system within the putter head assembly. The laser system comprises one or more laser units which contain the lasers, one or more laser holders, a laser module, an on-off program switch, and a power supply assembly. The laser system preferably further comprises an electronics micro-chip with an LED system, a time delay function, and an automatic off function.

A second benefit of the present invention is that the laser system facilitates alignment of the two parallel lasers during manufacture of the golf clubs. Within the present laser system are two laser holders which fit into a laser module. This provides a system for aligning the laser beams and fixing them in place, even during later impacts of the putter head member with the golf ball.

Another benefit of the present invention is that the laser beams in the present invention project directly from the anterior face of the head, which is where the club strikes the ball. Having the parallel lasers project from the anterior face of the club head is advantageous in part because when the lasers are activated and the club is swung, the laser beams follow the path of the ball along the playing surface and optionally onto a reflective practice target.

Further, a laser system so compact that it fits within a standard size putter head is advantageous because the laser system is easy to remove for repair. The putter is easier to manufacture because the laser system can be assembled and then inserted in the putter head member.

BRIEF SUMMARY OF THE INVENTION

The present invention is a golf club putter with a laser system for practising putting, comprising:

(a) a putter assembly which comprises a putter head member comprising two laser ports on an anterior putting face of the putter head member; and (b) a compact laser system comprising two or more laser units, laser holders, a laser module, an on-off program switch, and a power source;

wherein each laser unit is contained within a laser holder, and the laser holders are affixed to the laser module; the laser system is operable to produce parallel laser beams projected from the anterior putting face; the on-off program switch is connected to the power source; and the laser system is housed entirely in the putter head member; and whereby the laser beams are visible to assist a golfer during putting practice.

BRIEF DESCRIPTION OF THE SEVERAL VIEWS OF THE DRAWINGS

A more complete understanding of the invention and its advantages will be apparent from the following detailed description taken in conjunction with the accompanying drawings, wherein examples of the invention are shown, and wherein.

DETAILED DESCRIPTION OF THE INVENTION

Figure 1:
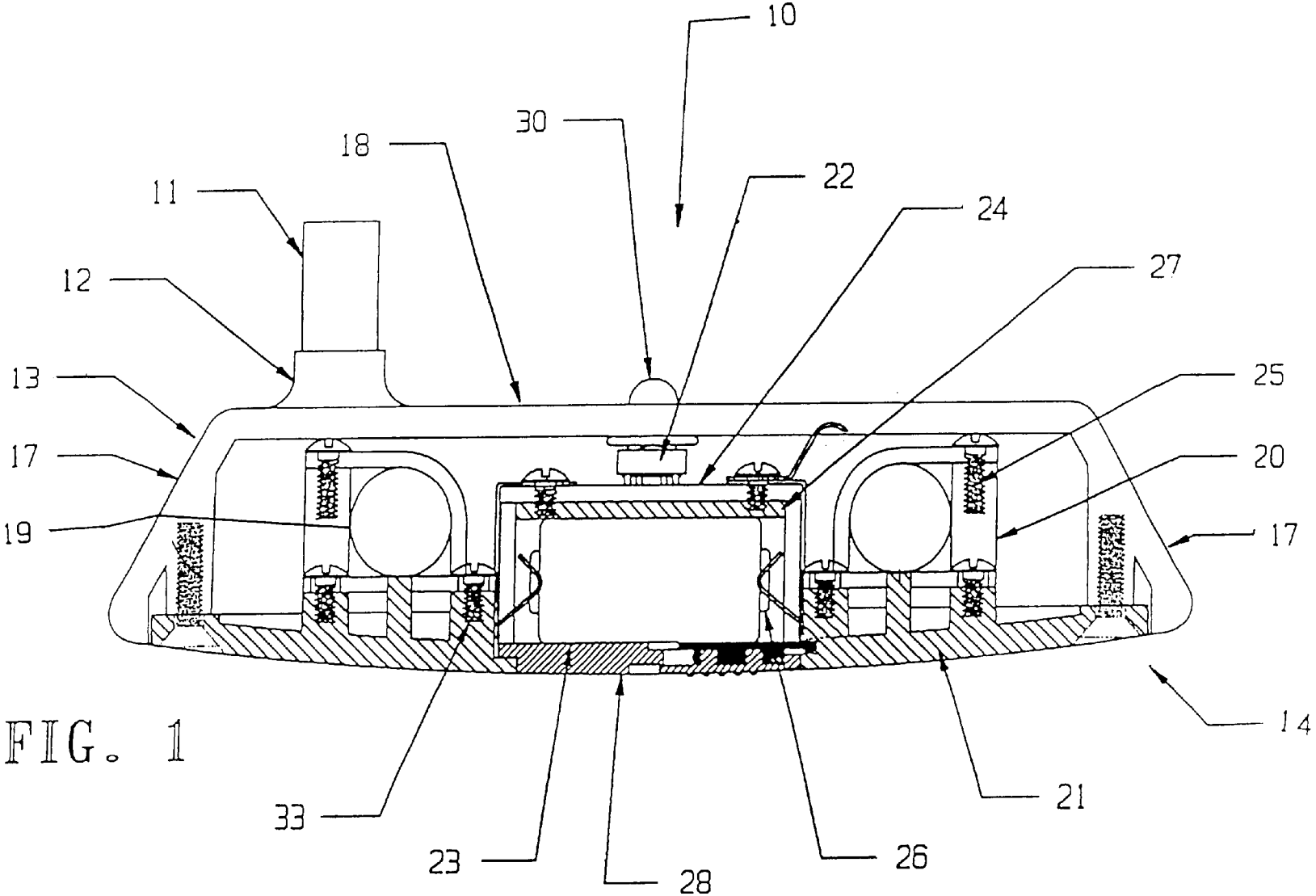
FIG. 1 is a cross-sectional view of a golf putter head with a compact laser system according to the present invention.

In the following description, like reference characters designate like or corresponding parts throughout the several views. Also, in the following description, it is to be understood that such terms as "front", "back", "within," and the like are words of convenience and are not to be construed as limiting terms. Referring in more detail to the drawings, the invention will now be described.

Referring to FIG. 1, a putter assembly 10 has a grip (not shown), a shaft 11, hosel 12, and putter head member 13, and a laser system 14. The putter head member 13 comprises: a) an anterior face 15, which contacts the golf ball; b) a posterior face 16 (see FIGS. 2 and 3); c) two sloped sides 17; d) a relatively flat top face 18; and e) a bottom face which contacts the playing surface.

As seen in FIG. 1, the laser system 14 comprises: a) one or more laser units 19 which contain the lasers; b) one or more laser holders 20; c) a laser module 21; d) an on-off program switch 22 (see FIG. 2); and e) a power supply assembly 23. The laser system 14 preferably further comprises f) an electronics microchip 24 with an LED system, a time delay function, and an automatic off function. Once the laser system 14 is assembled, it is inserted into the bottom of the putter head member 13 and fixed with two module screws 25. In this preferred embodiment, the majority of the bottom face of the putter head member 13 is the bottom surface of the laser module 21. The laser module 21 includes a battery 26 as the power source and a battery holder 27, which forms a portion of the laser module. The bottom of the battery holder 27 comprises a fastenable battery door 28 so the battery 26 can be replaced by the user when necessary. Once it is assembled, the bottom face of the putter head member 13 has an arcuate shape. The battery door 28 is recessed so the bottom face of the putter head member 13 is smooth and does not catch on the playing surface.

Figure 10:
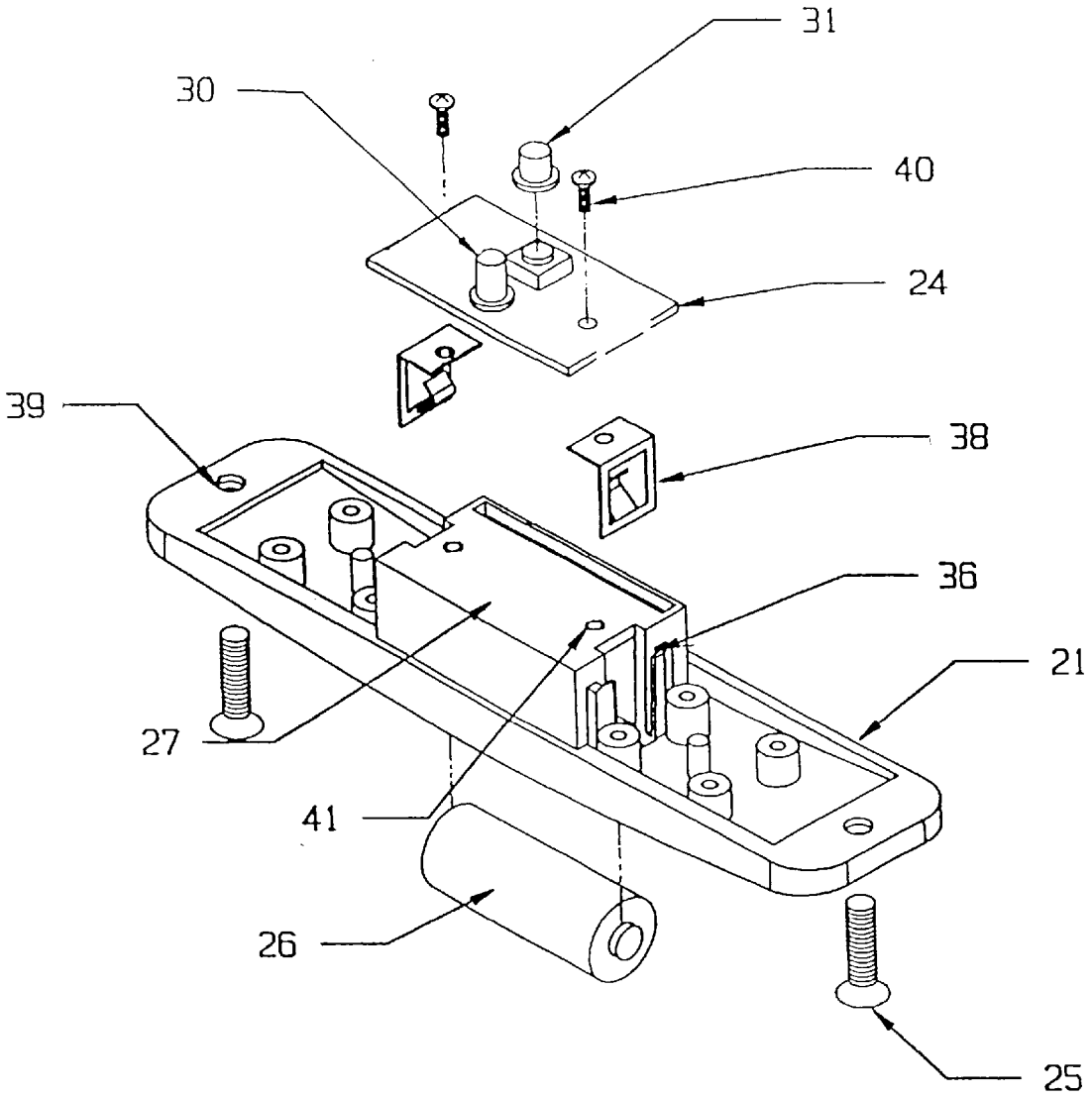
FIG. 10 is an isometric view from the top of an alternate embodiment of a laser module of a compact laser system according to the present invention.
Figure 11:
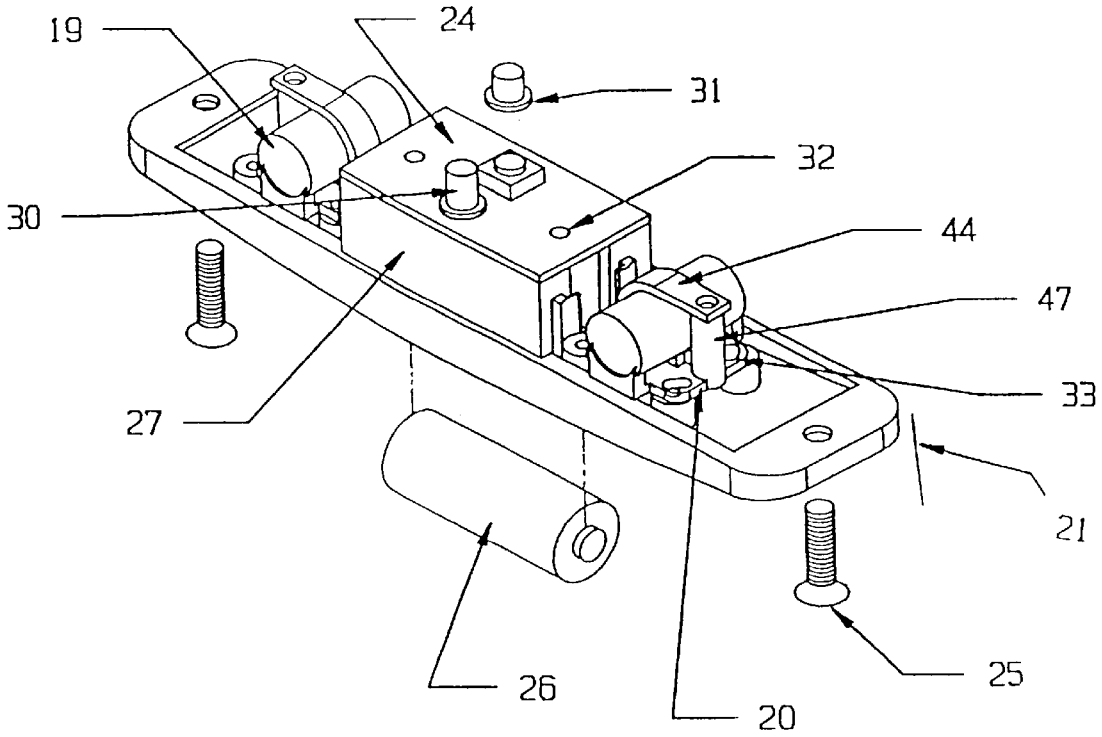
FIG. 11 is an isometric view from the top of a laser module according to FIG. 10 with the laser holders in place.

Here, the electronics microchip 24 comprises an LED system 29 with an LED light 30 and a push button 31 (see FIGS. 10 and 11). The electronics microchip 24, here a PC board, is removably affixed to the laser module 21 with PC screws 32. The PC board is preferably removably affixed to the top of the module's battery holder 27.

Here, two laser units 19, which are purchased from a supplier, are each fastened in a laser holder 20. The two laser holders 20 are each then removably affixed to the laser module 21 on either side of the battery holder 27 with laser holder screws 33 (see also FIGS. 4–11).

During manufacture, the cylindrical laser units 19, which are battery-shaped, are purchased from a supplier. Unfortunately, the laser units are not aligned when they arrive from the supplier. If the laser units are simply fixed in place behind the laser ports 34 (see FIG. 3) in the putter head, the laser beams frequently do not point straight ahead. It is very difficult to align two parallel laser beams. The present laser system has been developed to allow the alignment of two parallel laser beams. It could be adapted for one laser, e.g. with a split laser beam, or for three or more lasers.

Figure 2:
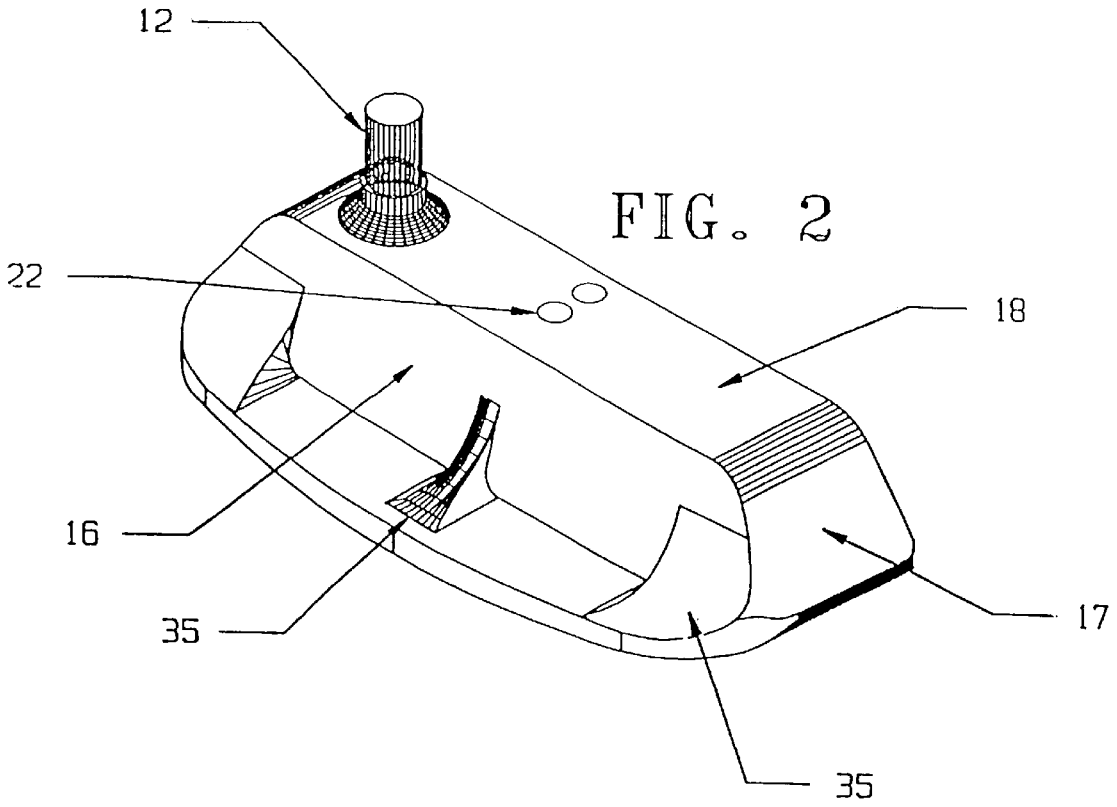
FIG. 2 is an isometric view of the posterior face of a putter head according to the present invention.

FIG. 2 is an isometric view of the posterior face 16 of a golf putter according to the present invention, showing some decorative curves 35. Generally, each plane in the putter head member 13 is blended gradually into the adjacent plane so that the edges are smooth. At the top of the putter head member 13, two equal-sized holes are shown for the on-off program switch 22 to turn the lasers on. Even though it houses an entire laser system 14, the putter head member 13 is standard sized. The putter head member 13 is preferably approximately 4.483 inches at its longest point, 1.796 inches at its widest part, and 1.074 inches thick.

Figure 3:
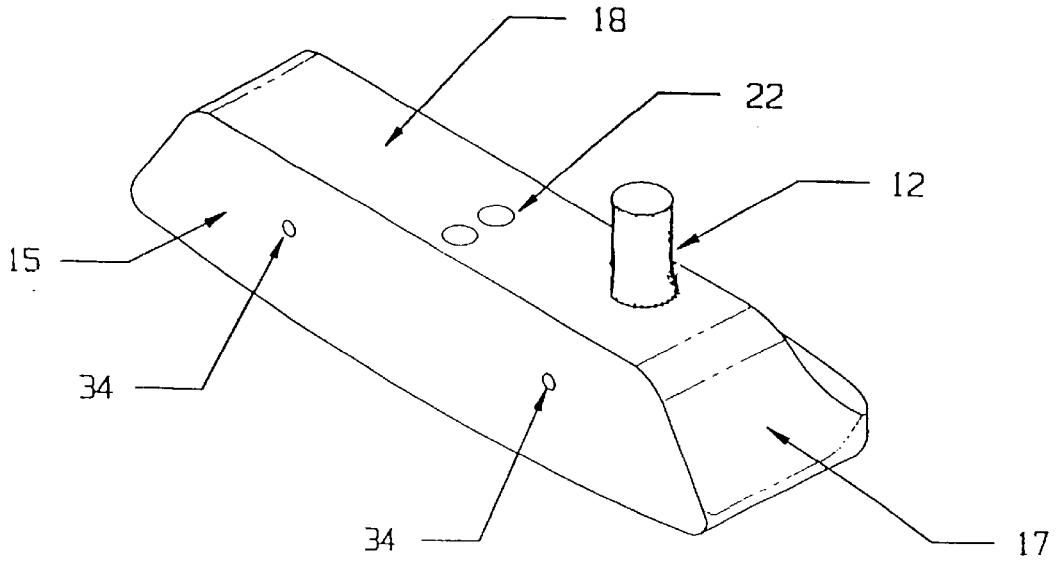
FIG. 3 is an isometric view of the anterior face of a putter head according to the present invention.

The anterior face 15 of the golf putter head shown in FIG. 3 contains two same-sized laser ports 34. When the laser units 19 are in place within the putter head member 13 and illuminated, the laser beams shine through the two laser ports 34. Two same-sized holes for the on-off program switch 22 are shown on the top face 18 of the putter head member 13 (see FIG. 1).

Figure 4:
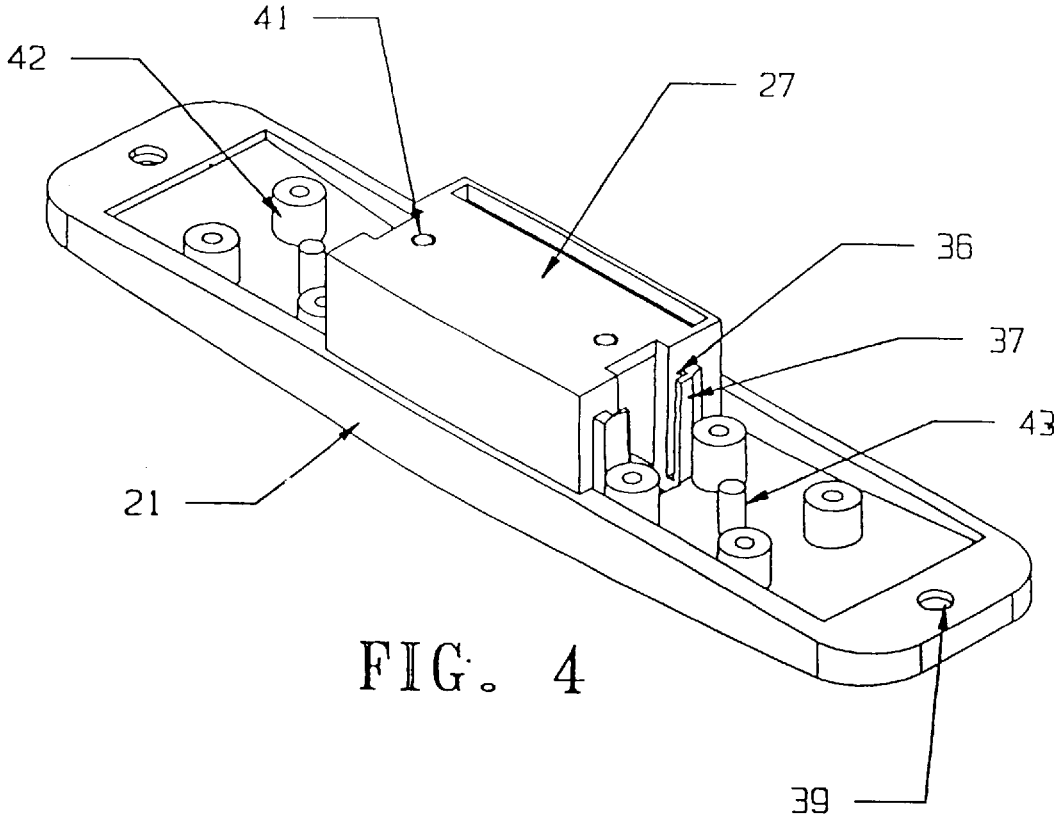
FIG. 4 is an isometric view from the top of the laser module mounting platform of a compact laser system according to the present invention.
Figure 5:
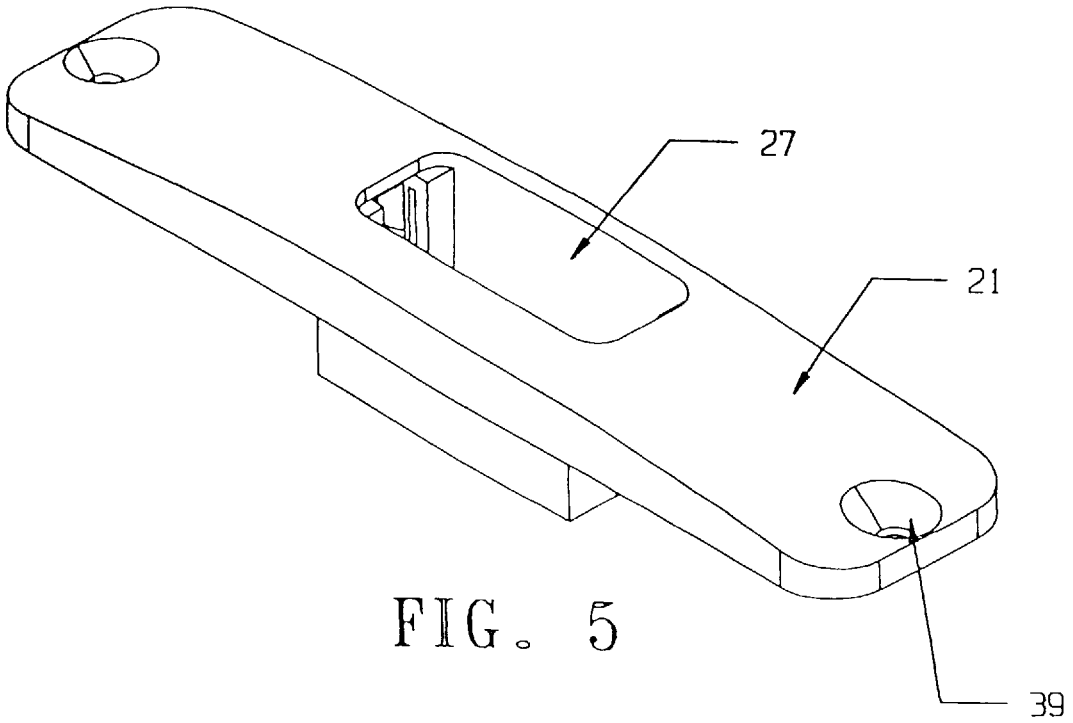
FIG. 5 is an isometric view from the bottom of the platform shown in FIG. 4.

FIGS. 4 and 5 are isometric views from the top and bottom, respectively, of the mounting platform portion of the laser module 21 of a compact laser system 14. FIG. 4 shows the battery holder 27. A removable battery 26, preferably a six volt battery, can be inserted into the chamber of the battery holder 27 from the bottom of the putter head member 13 by means of the closable battery door 28. Along the shorter sides of the battery holder 27 are recessed battery holder channels 36 and female brackets 37 which will accommodate PC/battery terminals 38 (see FIG. 10). Once the PC board 24 is fixed in place on top of the battery holder, the two PC/battery terminals 38 are fastened down over the two short edges of the rectangular-shaped PC board 24. The PC/battery terminals 38 hold the PC board 24 in place and, more importantly, they cause the power from the battery to be conducted to the PC board 24.

In FIGS. 4 and 5, at the short sides of the generally rectangular laser module 21 are two laser module screw holes 39 through which the laser module screws 25 will be placed to fasten the laser module 21 to the putter head member 13. The PC board 24 is fastened to the battery holder by placing battery holder screws 40 through battery holder holes 41. Laser module corner posts 42 and center posts 43 receive the two laser holders 20 (see FIGS. 6 and 7).

Figure 6:
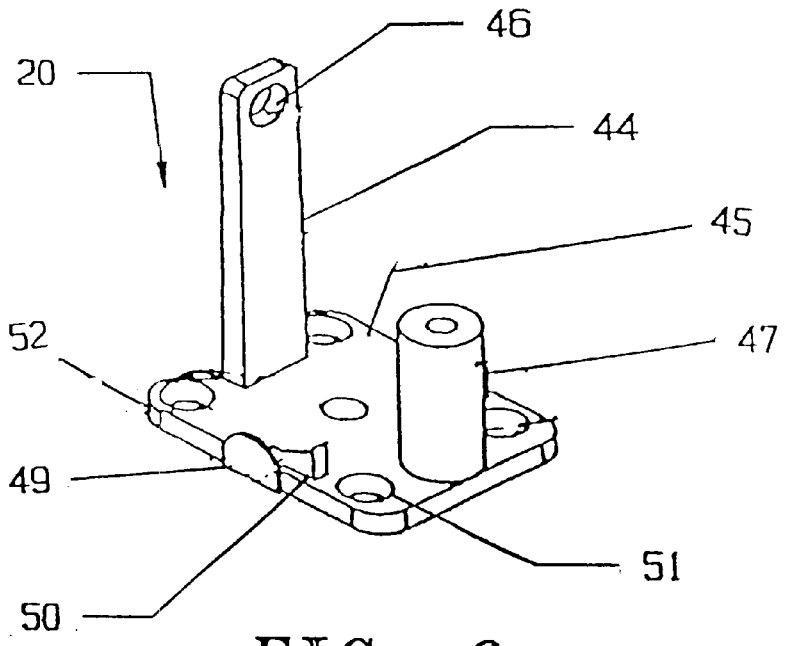
FIG. 6 is an isometric view from the top of a laser holder from a compact laser system according to the present invention, showing the flexible strap extended.
Figure 7:
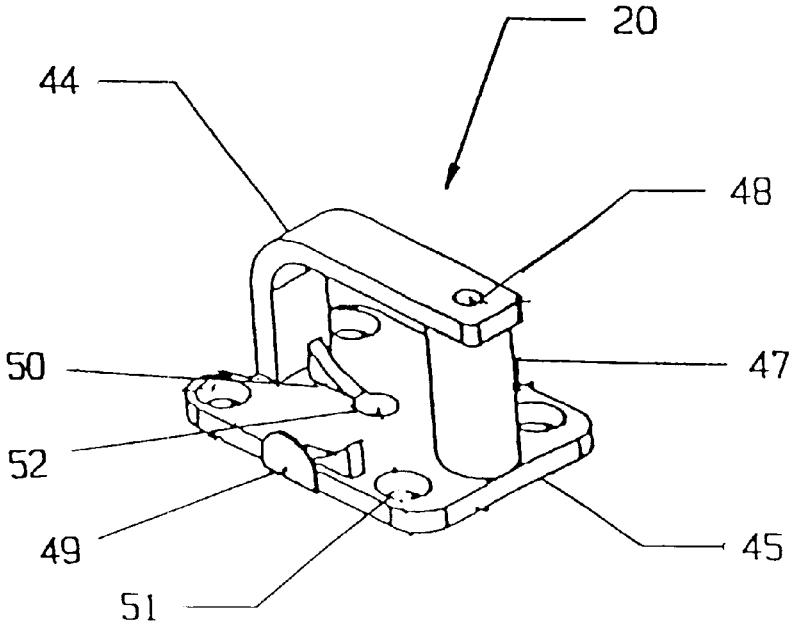
FIG. 7 is an isometric view from the top of a laser holder from a compact laser system according to the present invention, showing the flexible strap folded.

FIG. 6 and 7 are isometric views from the top of laser holders 20 from a compact laser system 14 according to the present invention. The laser holder 14 preferably performs dual functions: 1) to hold the laser unit 19 firmly in place in the golf club head even when the club swings and impacts the golf ball, and 2) to allow the laser unit 19 to be aligned during manufacture of the putter as described above.

The laser holder 20 has a flexible strap 44 which is shown extended. The flexible strap 44 extends from the laser holder platform 45. Once the laser unit 19 is placed in the laser holder 20, the free end of the flexible strap 44 is locked down over the laser unit 19 to hold the laser unit 19 in place. The laser holder strap hole 46 on the free end of the flexible strap 44 is locked down on the end of the laser holder post 47, which projects upward from the laser holder platform 45, using a flexible strap screw 48 (see FIG. 9).

Laser holder tab 49 is preferred in order to help prevent the laser unit 19 from backing out of the laser holder 20 once the laser unit 19 is locked in place. There is also preferably a similar holder tab on the opposite side of the laser holder 20 (not shown). FIG. 7 (but not FIG. 6) shows an additional preferred feature: a laser holder buttress 50, to more firmly fix the laser unit 19 in the laser holder 50. An additional holder buttress 20 is preferably placed on the side of the laser holder platform 45 adjacent to the laser holder tab 49 as shown to help prevent the laser unit 19 from rolling. The laser holder 20 also comprises four laser holder corner holes 51 at each corner of the laser holder platform 45 to accommodate the four same-sized laser holder screws 33. In the center of the laser holder platform 45 is a laser holder center hole 52.

Figure 8:
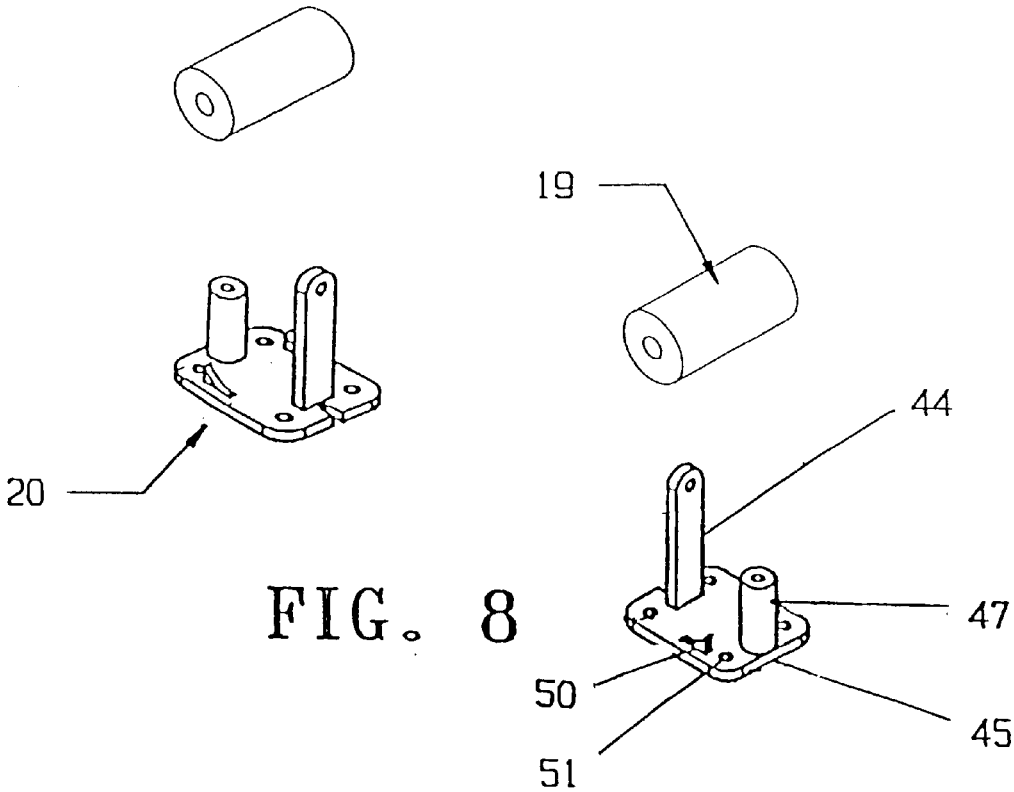
FIG. 8 is an isometric view from the top of an alternate embodiment of two laser holders from a compact laser system according to the present invention, showing the laser units above the laser holders.
Figure 9:
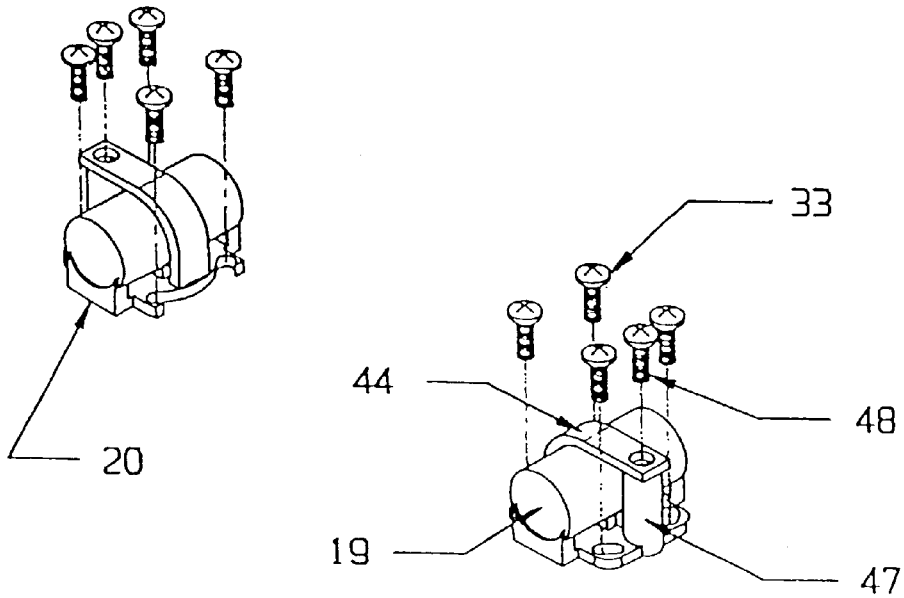
FIG. 9 is an isometric view from the top of the two laser holders shown in FIG. 8, which shows the laser units in the laser holders.

FIGS. 8 and 9 show two laser holders 20 from a compact laser system 14 in a putter assembly 10. These laser holders 20 are alternate embodiments from the laser holders 20 shown in FIGS. 6 and 7. These laser holders 20 do not have the preferred laser holder tab 49 or the laser holder buttress 50 at the flexible strap 44. During manufacture of the golf club, the two laser units 19 are placed into the laser holders 20 as shown in FIGS. 8 and 9. The four remaining laser holder screws are used when the two laser holders 20 are fixed into the laser module 21.

The laser module 21 shown in FIGS. 10 and 11 differs somewhat from the preferred laser module shown in FIG. 4. A battery 26 is shown below the laser module 21 in FIGS. 10 and 11. The laser module 21 is fixed into the chamber of the putter head member 13, where it is protected by the cast metal putter head, using the four module screws 25 shown below the laser module 21 in these figures. A battery 26 is inserted into the battery holder 27 from below as indicated.

Figure 12:
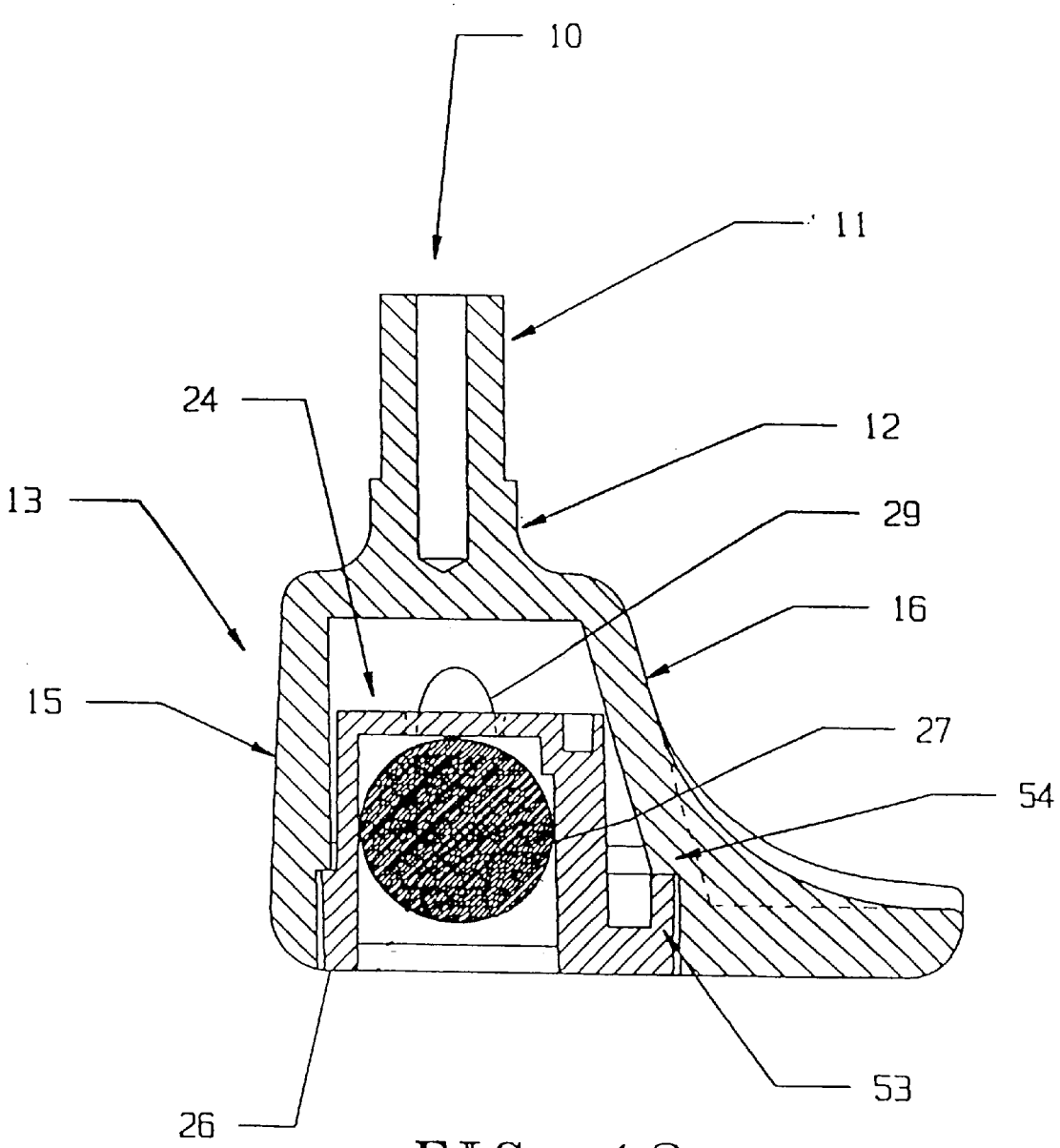
FIG. 12 is a cross-sectional view from the side of a putter comprising a laser module according to the present invention.

FIG. 12 is a cross-sectional view as seen from the side of a putter head member 13. On the left side of the figure is the anterior face 15 and on the right side is the posterior face 16 of the putter head. The hosel 12 is shown at the top of the putter head member 13 and is connected to a center rod or shaft 11. The anterior face 15 of the putter is preferably at a three degree angle for optimal striking of the golf ball. The laser module 21 preferably comprises module shoulders 53 along the long sides of the module so that the module remains stable when it is inserted in the cavity within the putter head member 13. At the center of the laser module 21 in FIG. 12 is the battery 26. Above the battery holder 27 is the electronics microchip (PC board) 24 with the LED system 29.

Figure 13:
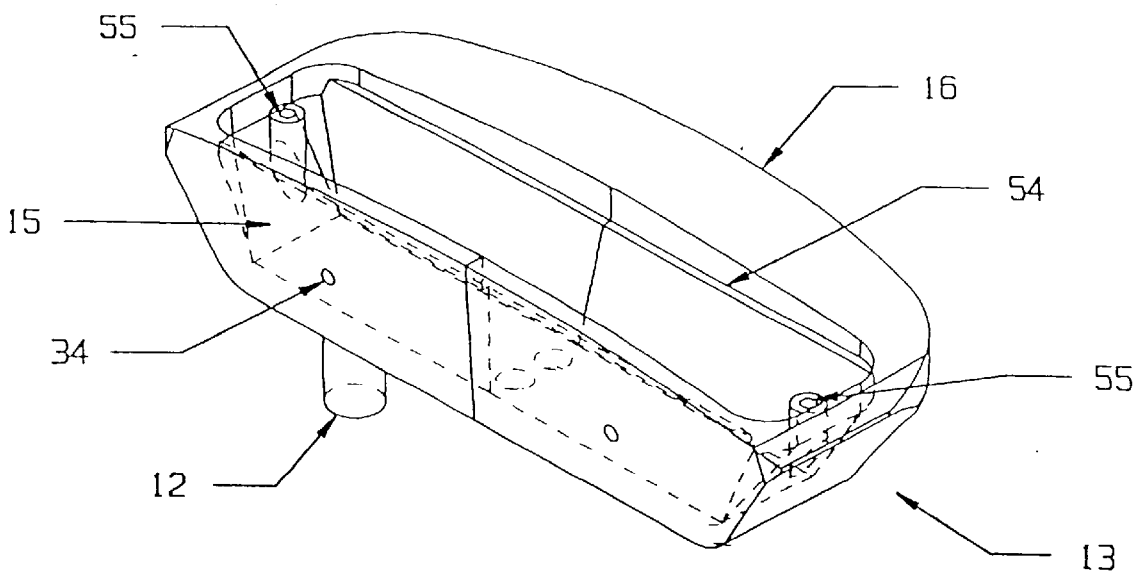
FIG. 13 is an isometric view of the bottom of a putter head according to the present invention as seen from the anterior face.
Figure 14:
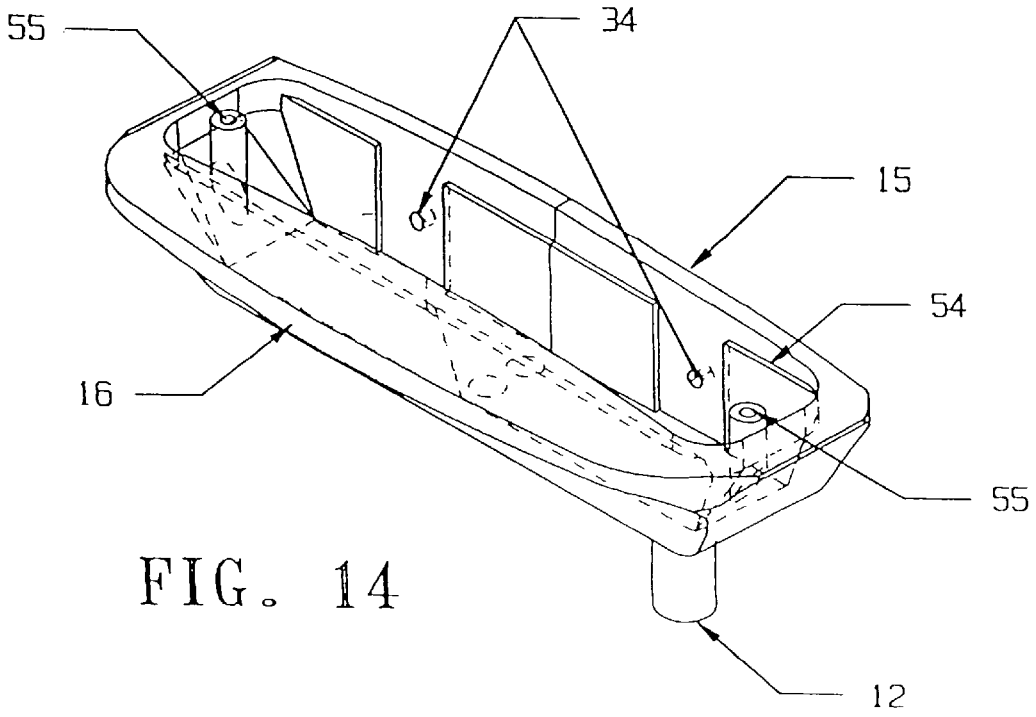
FIG. 14 is an isometric view of the bottom of a putter head according to the present invention as seen from the posterior face.

FIGS. 13 and 14 are views of the bottom of a putter head member 13 from the anterior 15 and posterior 16 faces, respectively, of the putter head member 13. In the anterior face 15, the laser ports 34 can be seen. The hosel 12 is shown at the top of the putter head member 13, which is shown at the bottom of the two figures. Putter head shoulders 54 have been etched along the inside edge of the putter head member 13. The laser module shoulders 53 will fit against these putter head shoulders 54 to optimize the fit of the laser module 21 in the putter head. The laser module 21 is attached to the putter head member 13 at the putter head screw holes 55.

Figure 15:
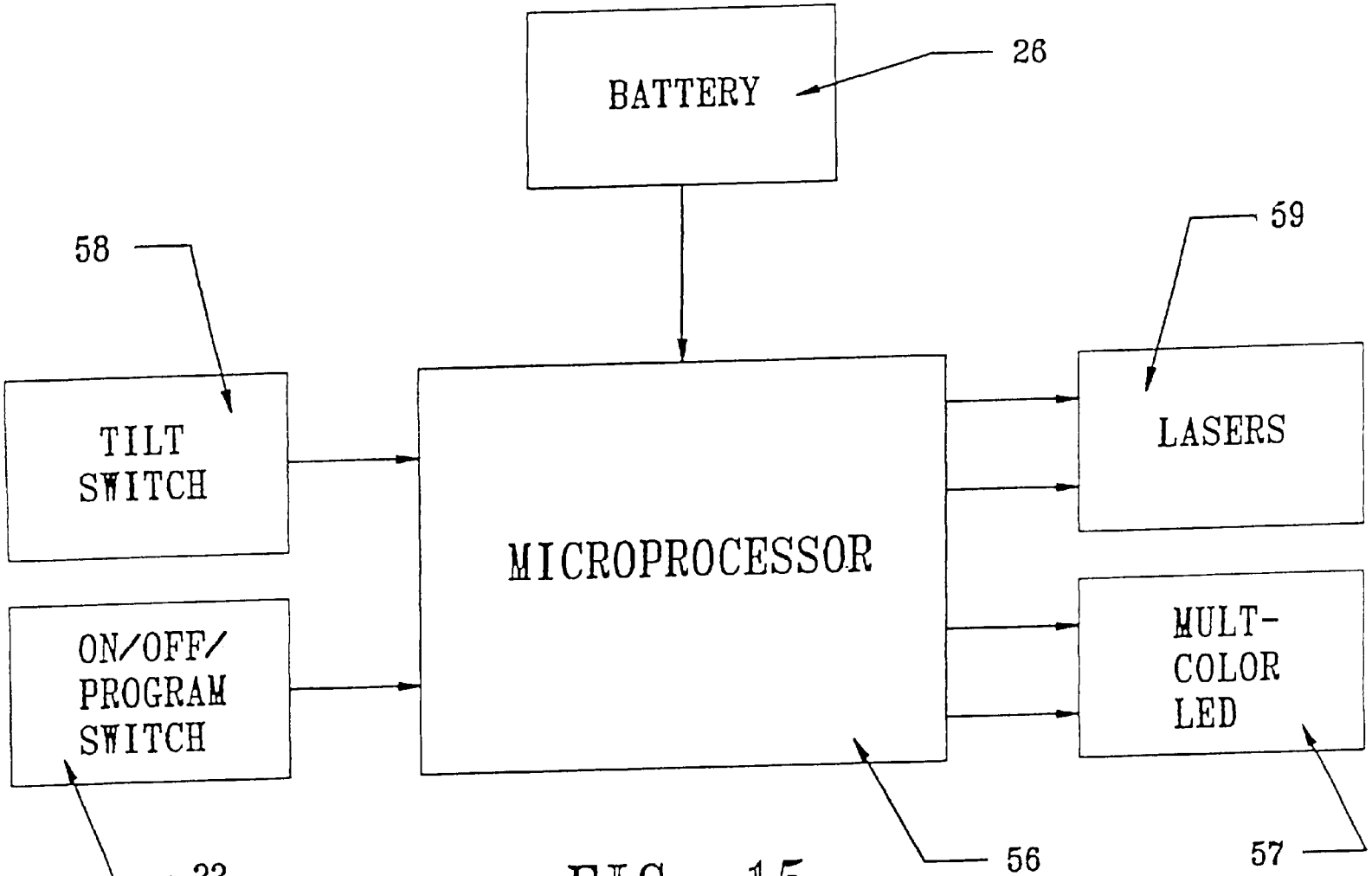
FIG. 15 is a block diagram for a preferred circuit to operate a putter according to the present invention.

FIG. 15 is a block diagram for a preferred circuit to operate the putter. It comprises a battery 26, a tilt switch 58, and an on/off program switch 22 which input to a microprocessor 56, and the microprocessor 56 outputs to two lasers 59 and a multi-color LED 57. The circuit comprises:

a) a microprocessor;

b) a battery, which provides power to the microprocessor;

c) a tilt switch and an on/off program button, which input to the microprocessor;

d) two lasers and a multi-color LED, which are controlled by the output of the microprocessor; and e) a resistor, which regulates power to the multi-color LED.

Regarding FIG. 15, the many operating features possible with the present putter despite its small size is due largely to its powerful microprocessor 56. The outputs are TTL rated (current up to 25 MA). This allows the microprocessor to direct drive LEDs and lasers with no external components, which saves valuable space in the putter head. The unique algorithm enables one push button to turn on or off the electronics and also user program the time delay and run times. A multi-color LED 57 aids in programming and determining that the golf club is reset in time delay mode or run laser mode. A tilt switch 58 is used to reset and go to start mode. The microprocessor will turn off the club after a specific period of non-use. The battery size and voltage allows the microprocessor 56 to run without a voltage regulating circuit, which also saves space.

The microprocessor oscillator and reset circuit are built into the microprocessor 56, which saves space. The microprocessor 56 never turns off while the battery 26 is installed. The microprocessor is preferably a surface mount microprocessor Even when the club is turned off with the on/off program switch 22, the microprocessor "goes to sleep". Programmed information in ram is saved and an external EEprom is not necessary. One problem solved by this microprocessor is that lasers 59 are of different intensity. Here, the stronger laser can be oscillated to look the same as the weaker laser before the program is installed in the microprocessor 56. The algorithm is modified to enable the stronger laser to look the same as the weaker laser.

The PC board is preferably about 1 to 2 mils long, 0.3 to 1 mils wide, and 0.01 to 0.1 mils thick. It is most preferably 1.24×0.64 mils. The lasers in the laser units are preferably between about 600 and 670 nm., more preferably about 650 nm. so as to be visible to the golfer practising his or her putting stroke.

The present invention has many advantages. The golf club employed in the present invention preferably comprises a standard sized or slender grip since there need be no concern about fitting a power supply or other laser equipment in the grip. In fact, there is preferably no equipment related to the laser system in the remainder of the putter. In the present invention, the entire laser system is housed in the putter head member. Where it connects to the club shaft, the hosel preferably comprises an S-configuration (i.e. a swan neck). The shaft of the present invention is preferably straight and traditional.

Another advantage of the present invention is that the laser beams project directly from the anterior face of the putter head member, which is where the putter strikes the ball. In this way, the present golf club with laser system has an advantage over a laser system placed elsewhere (in part or in entirety) in a putter. Having the lasers project from the anterior face of the club head is advantageous in part because when the lasers are activated and the club is swung, the laser beams follow the path of the ball along the playing surface. A user putting indoors on a carpet, for example, can follow the two parallel red laser beam paths visually as the golf ball rolls along the carpet and onto the reflective surface of a putting target. The user can thus diagnose problems with his or her putting stroke and make adjustments. The user ideally practices repeatedly with the present laser putter until his or her stroke is improved.

Having a laser system so compact that it fits within a standard size golf head, preferably a putter head, is also advantageous because the laser system is easy to remove for repair. The club is also easier to manufacture because the laser system can be assembled and then inserted in the club head housing. There are no wires, for example, to run up the center shaft of a hosel, and no power supply to squeeze into a grip.

A fourth advantage is that the PC board in the laser system of the present invention preferably has a time delay function, a reset feature, and an automatic off function. The settings can be tailored by the golfer as desired and later changed by him or her. When the club is used next, this laser system can "remember" the user's previous time settings.

From the foregoing it can be realized that the described device of the present invention may be easily and conveniently utilized as.

While preferred embodiments of the invention have been described using specific terms, this description is for illustrative purposes only. It will be apparent to those of ordinary skill in the art that various modifications may be made without departing from the spirit or scope of the invention, and that such modifications are intended to be within the scope of the present invention.

What is claimed is:

1. A golf club putter with a laser system for practising putting, comprising:

(a) a putter assembly which comprises a putter head member comprising two laser ports on an anterior putting face of the putter head member; and (b) a compact laser system comprising two or more laser units, laser holders, a laser module, an on-off program switch, and a power source;

wherein each laser unit is contained within a laser holder, and the laser holders are affixed to the laser module; the laser system is operable to produce parallel laser beams projected from the anterior putting face; the on-off program switch is connected to the power source; and the laser system is housed entirely in the putter head member; and whereby the laser beams are visible to assist a golfer during putting practice.

2. A putter according to claim 1, wherein the putter assembly further comprises a shaft, the shaft being affixed at a first end to a grip and at a second end to a hosel, the hosel being affixed to the putter head member.

3. A putter according to claim 2, wherein the laser system further comprises an electronics microchip.

4. A putter according to claim 3, wherein the power source is a battery housed in a battery holder, the battery holder being affixed to the laser module between two battery holders.

5. A putter according to claim 4, wherein the electronics microchip is a PC board which comprises an LED system.

6. A putter according to claim 5, wherein the PC board further comprises a time delay function.

7. A golf club putter with a laser system for practising putting, comprising a circuit to operate the putter; the circuit comprising:

a) a microprocessor;

b) a battery, which provides power to the microprocessor;

c) a tilt switch and an on/off program button, which input to the microprocessor;

d) two lasers and a multi-color LED, which are controlled by the output of the microprocessor; and e) a resistor, which regulates power to the multi-color LED.

* * * * *